United States Patent [19]

Goldmeier

[11] Patent Number: 4,824,170

[45] Date of Patent: Apr. 25, 1989

[54] OUTDOOR SWIVEL CHAIR

[76] Inventor: Steven Goldmeier, 47 Barry La. South, Old Bethpage, N.Y. 11804

[21] Appl. No.: 163,608

[22] Filed: Mar. 3, 1988

Related U.S. Application Data

[63] Continuation-in-part of Ser. No. 597,694, Apr. 6, 1984.

[51] Int. Cl.[4] ..... A47C 7/62

[52] U.S. Cl. ..... 297/349; 297/130; 248/349; 248/425

[58] Field of Search ..... 297/349, 217, 130; 248/349, 425

[56] References Cited

U.S. PATENT DOCUMENTS

| | | | |
|---|---|---|---|
| D. 170,315 | 9/1953 | Gerber | 248/349 X |
| 2,512,995 | 6/1950 | Berger | 297/130 X |
| 2,914,793 | 12/1959 | McMahon | 297/349 X |
| 2,938,571 | 5/1960 | Simmerman | 297/217 |
| 3,891,171 | 6/1975 | Samuelian et al. | 248/349 |
| 4,378,943 | 4/1983 | Newberry | 248/349 |
| 4,720,140 | 1/1988 | Change | 297/349 |

FOREIGN PATENT DOCUMENTS

| | | | |
|---|---|---|---|
| 2518342 | 11/1975 | Fed. Rep. of Germany | 248/349 |

*Primary Examiner*—Francis K. Zugel
*Attorney, Agent, or Firm*—Kuhn and Muller

[57] ABSTRACT

A detachable swivel mechanism is disclosed for an outdoor chair adapted for regular or reclining use. The mechanism consists of a base, adjustable telescoping support members which may be attached to many different sizes and types of outdoor chairs and swivel means to which the telescoping members and base are connected. In one embodiment, the mechanism may have a circular base having a diameter of at least the same size as the width of the seat of the chair to which it is attached, and means at the periphery of the base providing a circular track thereon. A plurality of rigid supports may be provided to hold the seat above the circular base. Roller means are used to mount the lower end of these supports for movement along the track to permit the seat to swivel, and means overlying the circular track are used to hold the roller means on the track.

10 Claims, 7 Drawing Sheets

FIG. 8b
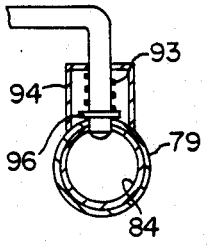
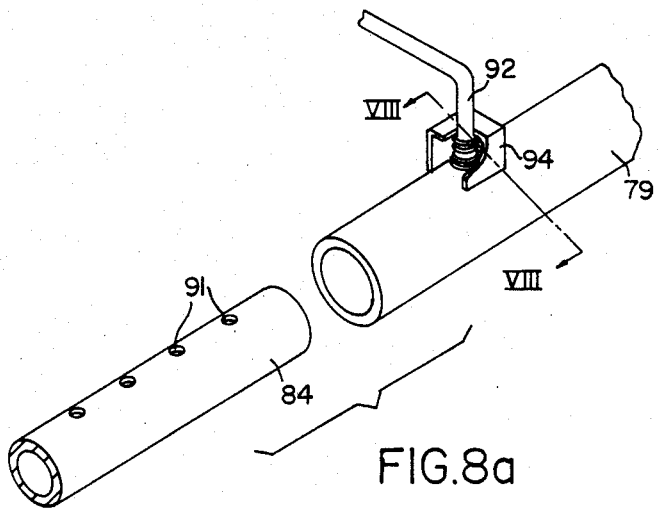
FIG. 8a
FIG. 9b
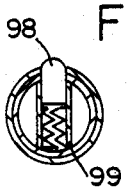
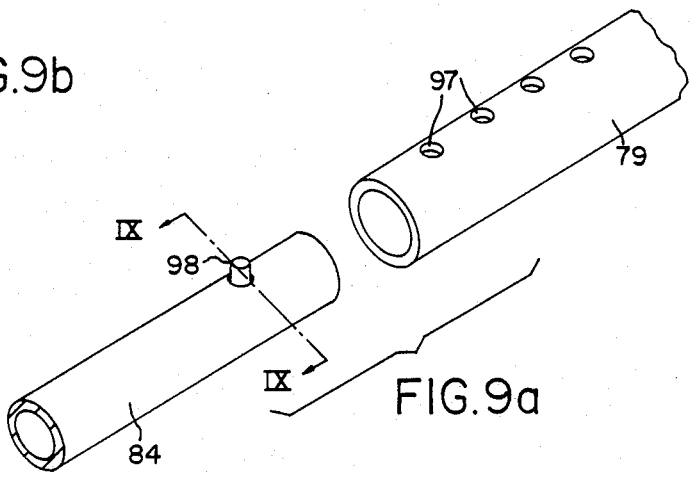
FIG. 9a

OUTDOOR SWIVEL CHAIR

This application is continuation-in-part of co-pending application Ser. No. 597,694 filed Apr. 6, 1984 for Outdoor swivel chair.

FIELD OF THE INVENTION

This invention relates to swivel chairs and lounges and more particularly to a detachable swivel base for converting standard outdoor lawn or beach chairs or lounges into swivel chairs. The base is adjustable so as to fit different sizes and styles of outdoor chairs and outdoor recliners.

BACKGROUND OF THE INVENTION

Various types of swivel mechanisms have been known heretofore for use with standard and recliner outdoor chairs. These prior mechanisms are exemplified for example in U.S. Pat. Nos. 2,687,765, 2,914,793 or 637,968 of record in the copending parent application. Such prior types of swivel chairs and mechanisms however have been poorly adapted for ordinary outdoor use as, for example, on lawns, near pools or on sandy surfaces. Lightweight outdoor chairs with swivel mechanism have not been available heretofore which enable people easily to carry the chair to a convenient outdoor location, to use the chair, to return the chair to storage and to clean the swivel mechanism when necessary without undue effort. In addition, such prior swivel chairs and mechanisms have not been known to provide adequate stability, especially on uneven terrain. Moreover, swivel mechanisms have not been available heretofore which are easily mountable to and demountable from a standard lightweight outdoor chair or recliner thereby enabling the conversion of virtually any such standard outdoor chair or recliner into a swivel chair.

Finally, outdoor swivel structures have not been heretofore available which will function properly even when constantly exposed to dirt or sand and which may be easily disassembled for suitable cleaning without undue effort. This has been due in part to the fact that outdoor furniture is usually relatively low cost furniture and suitably low cost swivel mechanisms have not heretofore been available for outdoor use.

SUMMARY OF THE INVENTION

The foregoing long felt needs and other disadvantages of the prior types of outdoor swivel chairs are met by an embodiment of the present invention in which a standard outdoor chair or recliner may be mounted to a swivel mechanism connected to the undersurface of the chair. The swivel mechanism is in rolling or sliding engagement with a circular base portion having a diameter which is at least substantially the same as the width dimension of the seat of the chair. Means are provided along the periphery of the circular base for enabling such rolling or sliding engagement with the swivel mechanism.

The seat of the chair may be supported from three to six inches above the circular base by a plurality of supports which descend from the seat and terminate in a circular swivel member adapted detachably to ride along the rolling means in the periphery of the circular base. In this way the seat of the chair may be rotated by the person sitting or reclining therein while the circular base remains stationary on the ground. The circular base may be detached from the seat and circular swivel mechanism for easy cleaning of the roller or sliding contacts in the base.

In the preferred construction of the swivel and base, the base is provided with a plurality of spaced-apart rollers each of which is provided with a central circumferential groove. The rollers are mounted in an appropriate track formed by a upper surface of the circular base. The circular swivel attached to the seat consists of a tube or rod which, in the assembled position, is located or rests within the grooves of the rollers. Suitable hold-down plates or flanges may be provided in appropriate locations around the base or, alternatively, around the swivel tube detachably to retain the swivel tube or rod in the grooves of the rollers.

In accordance with the present invention, a swivel mechanism is provided for detachable mounting on a standard fold-up outdoor chair or recliner. In the preferred embodiment, the swivel mechanism consists of a pair of parallel telescoping support members the distal ends of which are adapted releasably to engage the legs of the chair. The parallel supports are telescoping so as to enable their adjustment to different sizes and types of outdoor chairs or recliners. The telescoping supports are attached substantially at their center to a swivel mechanism which in turn is suitably connected to a stationary base member resting on the ground. In this way, any standard fold-up outdoor chair or recliner may be converted into a swivel chair.

BRIEF DESCRIPTION OF THE DRAWINGS

For a further understanding of the present invention, reference may be had to the following drawings, in which:

FIG. 8(*a*) is a perspective view of one embodiment of a telescoping support and means for locking such support in position;

FIG. 8(*b*) is a section view taken along the line VIII—VIII of FIG. 8(*a*);

FIG. 9(*a*) is a perspective view of another embodiment of a telescoping support and means for locking such support in position;

FIG. 9(*b*) is a section view taken along the line IX—IX of FIG. 9(*a*);

BRIEF DESCRIPTION OF THE PREFERRED EMBODIMENTS

Figure 1:
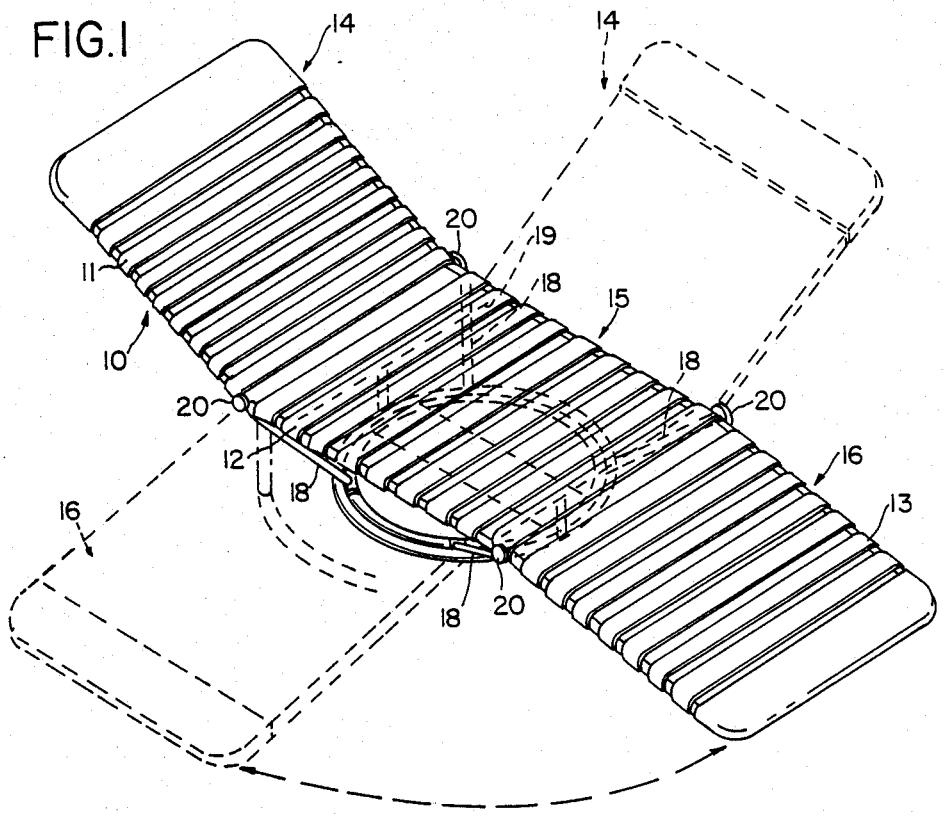
FIG. 1 is a perspective view of a lounge chair constructed in accordance with one embodiment of the invention, the swivel capacity of the chair being shown in phantom.
Figure 2:
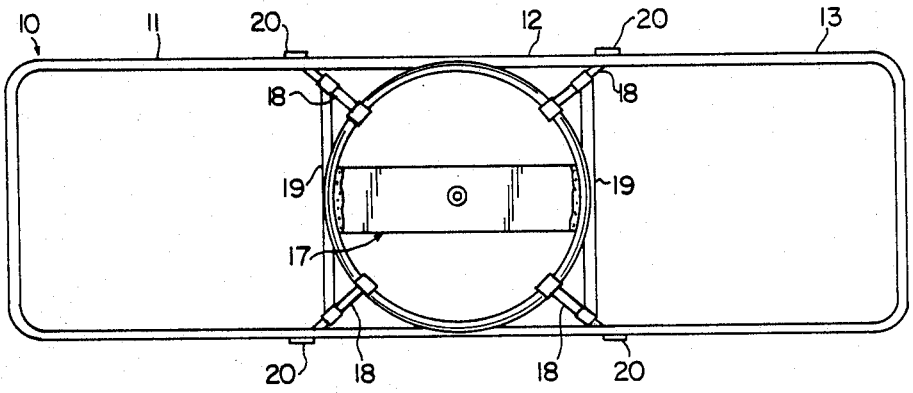
FIG. 2 is a top plan view of the lounge chair shown in FIG. 1 with the straps removed so that the frame construction and the swivel base support can be seen.

Referring now to the drawings and more particularly to FIGS. 1 and 2, the lounge chair 10 is of tubular frame construction, the tubular frame elements 11, 12 and 13 defining, respectively, a back portion 14, a seat portion 15 and a foot rest portion 16. Straps 17 extend around the frame elements 11, 12 and 13 to provide appropriate body support in known fashion.

The seat portion 15 is supported a few inches above a swivel base 17 by means of rigid supports 18 which are strengthened by braces 19. The frame elements 11 and 13 are pivoted to the frame element 12, which constitutes the seat, in conventional manner, these known pivot elements being identified at 20.

As shown in FIG. 1 the diameter of the swivel base 17 is such that the supports 18 depend inwardly from the periphery of the seat 12. For some types of chairs it may be desirable to provide a swivel base having a larger diameter so that the supports 18 depend vertically from the seat 12, as shown partially in phantom in FIG. 1. Such a swivel arrangement would provide increased stability and should be very lightweight to enable adequate mobility of the chair.

Figure 3:
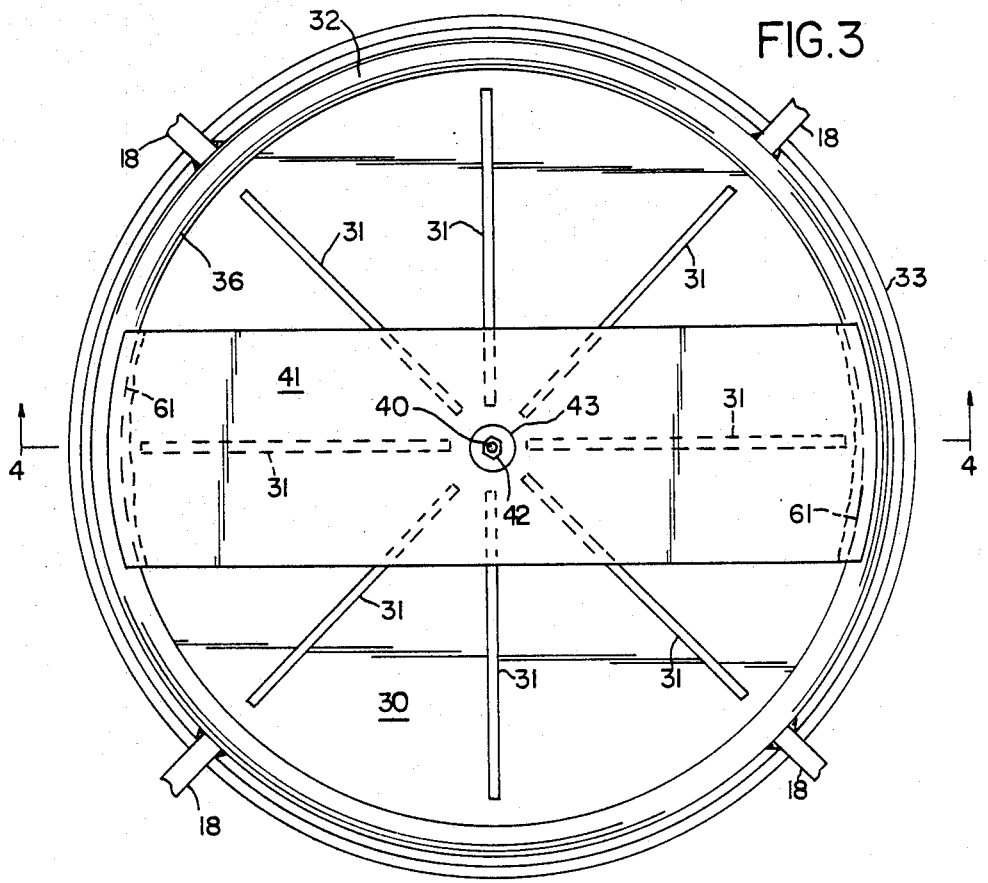
FIG. 3 is a top plan view of the swivel base support.
Figure 4:
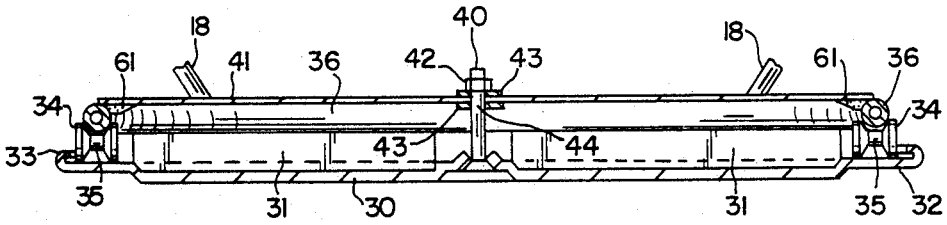
FIG. 4 is a cross-section of the swivel base support taken on the line 4—4 of FIG. 3.

The swivel base 17 is more fully shown in FIGS. 3 and 4 from which it will be seen that the chair rests upon a circular base 30 which is stiffened by upstanding-protuberances 31 and which is formed with a raised peripheral circular track 32 edged by an outer flange or bead 33. Rollers 34 formed with a circumferential groove 35 are spaced apart around the circumference of track 32. A circular tube 36 is rested in the grooves 35. As shown in FIG. 4, the rigid supports 18 may be welded to the circular tube 36.

A threaded post 40 is secured to the central axis of the circular base 30 and a plate 41 extends across base 30 and is rotatably supported above the base 30 by a bolt 42 and washers 43 which are positioned on both sides of a central hole 44 in the plate 41. The plate 41 partially covers the circular tube 36 and may be welded thereto, for example at 61, to hold it down when the load on the chair shifts. The support 18 is positioned relative to the plate 41 so as to avoid interfering with the swivel action.

As will be apparent, assembly of the swivel base merely requires appropriate placement of rollers 34 in track 32 followed by placement of the chair so that circular tube 36 rests within the grooves 35. Plate 41 is then positioned so that its central hole 44 receives the threaded post 40 and the plate is clamped into place by the bolt 42 to hold the assembly together.

Sand and dirt can be easily shaken out of the swivel base. In addition, as described above, the swivel mechanism can be easily disassembled for more thorough cleaning and then reassembled.

Figure 5:
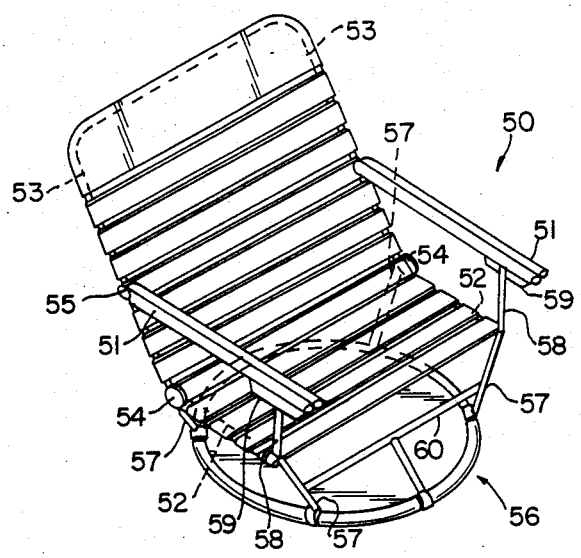
FIG. 5 is a perspective view of a swivel chair with arm rests.
Figure 6:
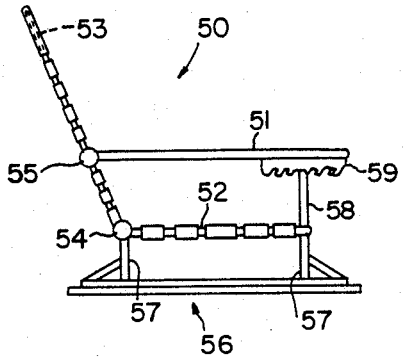
FIG. 6 is a side elevation of the chair shown in FIG. 5.

The chair 50 shown in FIGS. 5 and 6 has arm rests 51 and does not have a foot rest portion as previously described. As will be seen in FIGS. 5 and 6, the seat frame elements 52 are pivotally connected to back frame element 53 by means of pivots 54. Arm rests 51 are pivoted to the frame element 53 as indicated at 55. The seat frame elements 52 are held above the swivel base 56 by rigid supports 57. The details of the swivel base and the interconnection of the base with the supports 57 are the same as previously described in connection with the chair shown in FIGS. 1 and 2.

Vertical supports 58 are mounted at the forward end of the seat frame 52 to support the arm rests 51. The supports 58 carry conventional slotted positioners 59 which are engaged by the arm rests 51 in known fashion to position the reclining angle of the back frame 53. Braces 60 are also present to strengthen the seat support. Since a chair of the type shown in FIGS. 5 and 6 may have different support requirements for stability in the absence of the footrest portion on the chair shown in FIGS. 1 and 2, the diameter of the swivel base and the orientation of the depending supports 57 may be different from that depicted in the drawings. The swivel concepts of the invention however are the same.

Figure 7:
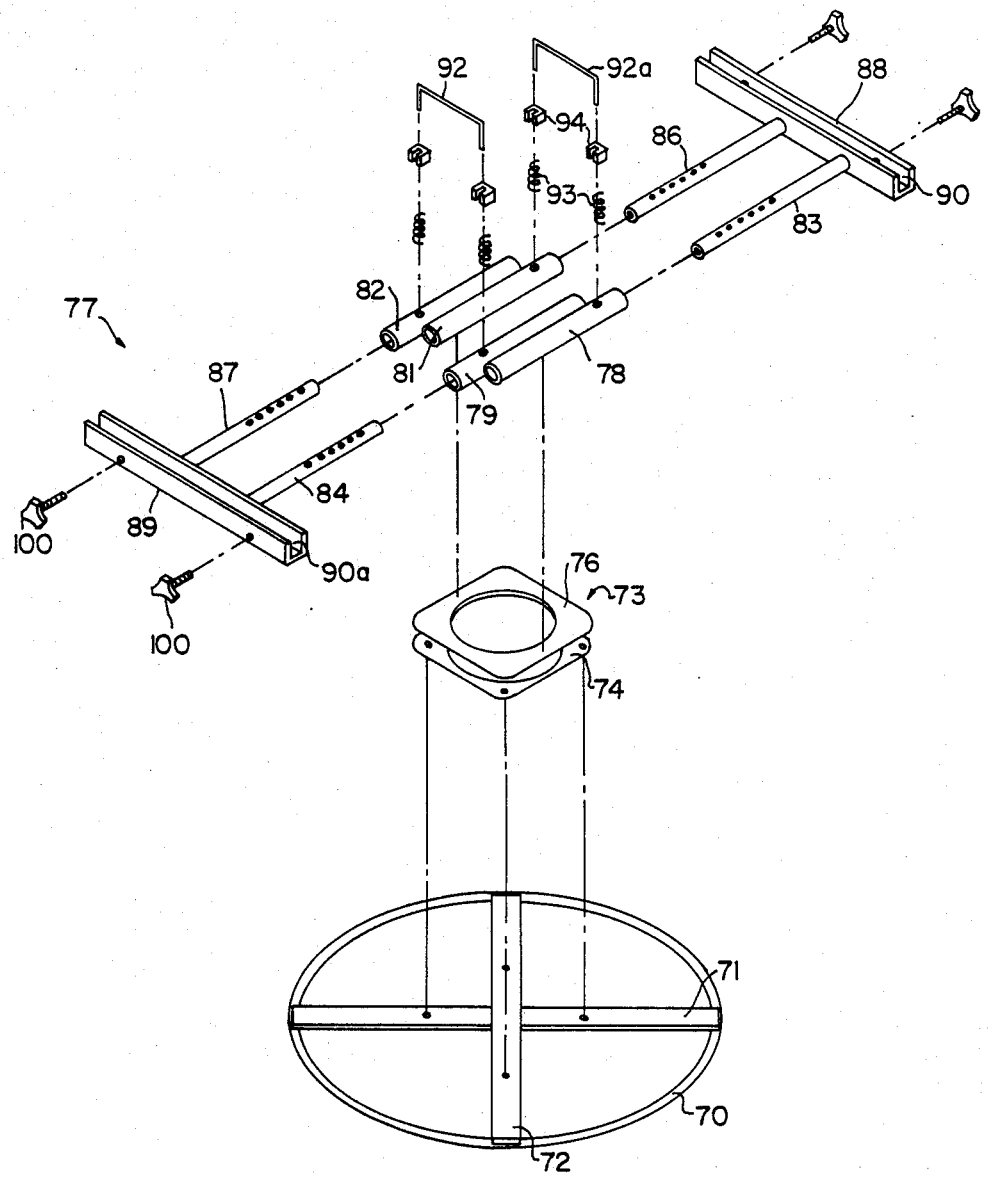
FIG. 7 is an exploded view of a demountable swivel and base mechanism which is adapted for use in connection with a standard outdoor chair including an outdoor lounge chair or recliner.

Referring now to FIG. 7, there is shown an exploded view of one embodiment of a detachable swivel mechanism which may be used with a standard outdoor chair. In this embodiment, the detachable mechanism consists of a preferably circular base member 70 adapted to rest on the ground. Suitable cross braces 71 and 72 extend diametrically across and strengthen the circular base 70. In the embodiment shown, the braces 71 and 72 are substantially orthogonal, although they may be oriented in any appropriate relative position so as to provide appropriate strength and support for the swivel device, described below.

The base 70 is preferably a tubular frame member made of aluminum for light-weight, strong and suitably inexpensive construction. It should be understood that the circular base 70 may, if desired, be of the same type and construction as the base 30, shown in FIGS. 3 and 4, if a swivel mechanism of the type described hereinabove is to be utilized.

As shown in FIG. 7, other conventional types of swivels, such as the swivel mechanism 73 may also be used if desired. Such a swivel consists of a lower plate 74 which is pivotally connected in conventional fashion to an upper plate 76 so that one such plate may be swivelled relative to the other. The lower plate 74 of the swivel mechanism 73 is suitably bolted to the cross braces 71 and 72 of the base 70.

The upper plate 76 of the swivel 73 is suitably connected to an adjustable telescoping chair support mechanism, generally indicated by reference numeral 77. In the preferred embodiment, the mechanism 77 consists of two pairs of tubular supports 78, 79, 81 and 82. The tubular supports 78–82 are rigidly fastened to the upper plate 76 of the swivel 73. Each of the tubular supports 78–82 is opened at one end so as slidably to receive corresponding tubular members 83, 84, 86 and 87 respectively. When engaged with the fixed tubular supports 78–82, each of the tubular members 83–87 may be slidably adjusted along its respective longitudinal axis, which corresponds to the respective longitudinal axis of each corresponding fixed member within which it rides. As described in detail below, means are provided to lock the slidable members 83–87 in different positions relative to the fixed tubular supports.

In the preferred embodiment, the slidable tubular members 83 and 86 are connected to a first channelled support element 88. In like manner, tubular members 84 and 87 are connected to a second channelled support element 89. The elements 88 and 89 extend substantially parallel to each other and substantially orthogonal to the longitudinal axes of the tubular members to which they are respectively attached. Each of the elements 88 and 89 is provided with a longitudinal channel 90 and **90*a* respectively. The arrangement is such that when assembled, the channelled supports 88 and 89** may be moved back and forth toward and away from each other thereby to be adjusted to different sizes and types of outdoor chairs, as described below.

Referring now to FIGS. 8(*a*) and 8(*b*), there is shown one embodiment of a means for releasably locking any one of the slidable tubular members, for example the tubular member 84, in position relative to its corresponding fixed tubular support 79. In this embodiment, the tubular member 84 is provided with a plurality of linearly aligned position setting openings 91. The fixed tubular support 79 is correspondingly provided with a locking piston member 92 which is mounted on the circumference of the tubular support 79 and is adapted to slide back and forth through an opening in the tubular support 79 so as retractably to extend into and out of the hollow center of the tubular support. The piston 92 is biased by a spring 93 to an inward locking position in which it is pressed toward the center of the tube 79. In that position it can engage and lock the tube 84 in a desired position established by having passed through one of the openings 91 of the tube 84. In this way the slidable tubular member 84 may be locked into any one of a plurality of positions relative to the corresponding tubular support 79.

A housing 94 surrounds the piston member 92. The piston 92 traverses the spring 93, one end of which presses against the inner top surface of the housing 94. A circular flange 96 surrounds the piston 92 and is engaged by the other end of the spring 93. In this way the piston is continuously biased by the spring toward the inner or locked position relative to the slidable tubular member 84.

As shown in FIG. 7, the piston 92 is preferably substantially U-shaped. In this way it may be connected to two fixed tubular supports, such as supports 79 and 82, thereby simultaneously engaging two of the slidable tubular supports, such as supports 84 and 87. A corresponding U-shaped piston 92*a* may be connected to the other two fixed tubular supports 78 and 81 thereby releasably to engage sliding supports 83 and 86 simultaneously in the same fashion.

With reference to FIGS. 9(*a*) and 9(*b*), there is shown an alternate embodiment of a means for locking the fixed and slidable tubular elements in a plurality of relative positions. In this embodiment, the fixed tubular element 79 is provided with a plurality of openings 97. The slidable tubular member 84 is provided with a reciprocating piston member 98 which is mounted so as to project outwardly from the tubular member 84 as shown. The piston 98 is spring biased to its outwardly extended position by an internal spring 99. In this embodiment, each of the slidable tubular members 83–87 is provided with a piston such as the piston 98 and may thereby be releasably fixed in any one of a plurality of relative positions vis-a-vis its corresponding fixed tubular member 78–82.

Figure 10:
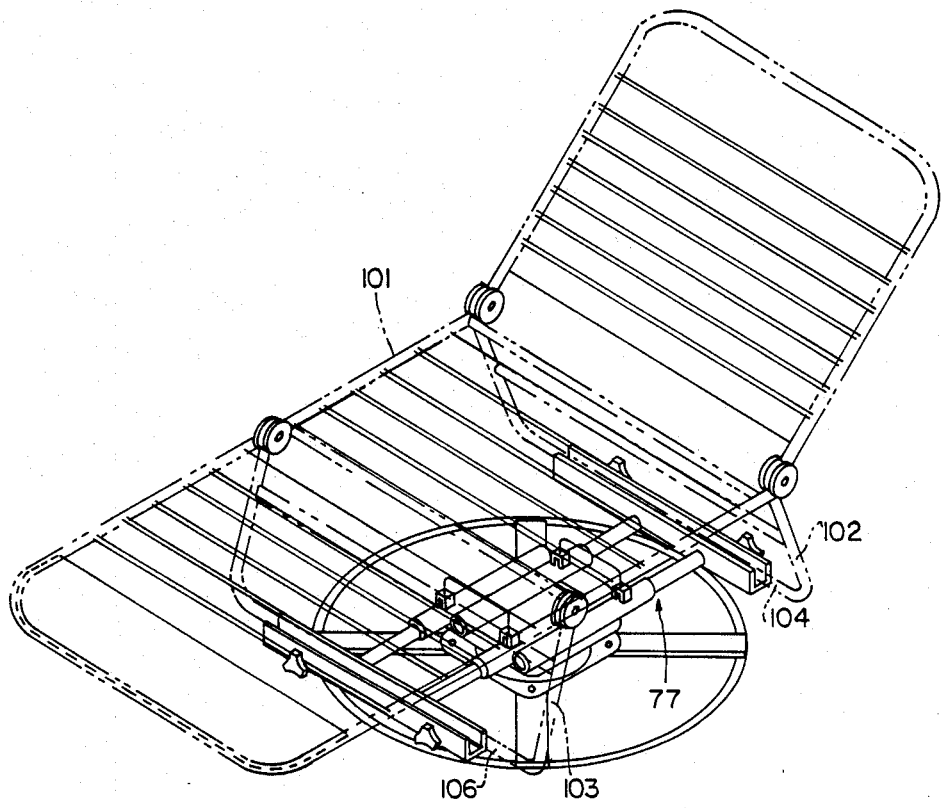
FIG. 10 is a perspective view of the detachable swivel mechanism of the invention shown attached to a standard fold-up outdoor lounge or recliner.

With reference now to FIG. 10, there is shown a standard outdoor lounge or recliner chair 101 mounted to the detachable swivel base and support of the present invention. Such standard outdoor chairs are usually provided with a pair of substantially U-shaped foldable legs 102 and 103 which are normally pivoted into position to engage the ground and thereby support the chair. In this type of chair, each of the U-shaped legs has a cross-bar 104 and 106 respectively. The cross-bars 104 and 106 extend across and beneath the chair in parallel directions generally orthogonal to the direction in which a person sitting in the chair would face.

In accordance with the present invention, the mechanism 77 is detachably mountable to the chair. For this purpose, the cross-bars 104 and 106 may be inserted to rest within the channels 90 and 90*a* respectively formed in corresponding channelled members 88 and 89. As shown in FIG. 7, a plurality of threaded bolt grips 100 may be provided in the channelled members to be turned so as to press against the cross bars of the chair legs after they are placed within the channels 90 and 90(*a*). As described above, the channelled supports 88 and 89 may be moved back and forth toward or away from each other in order to adjust the distance between them to the longitudinal distance between the cross-bars 104 and 106. In this way a standard lounge chair may be converted into a swivel chair by detachably mounting it to the swivel mechanism 77 of the present invention.

Figure 11:
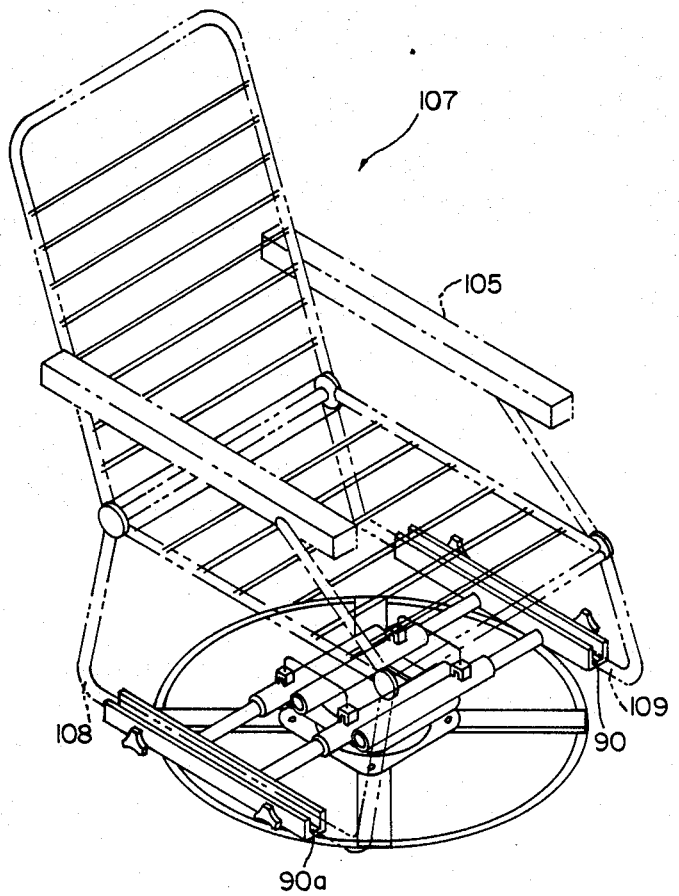
FIG. 11 is a perspective view of the detachable swivel mechanism of the invention shown attached to a standard fold-up outdoor chair having arm rests.

FIG. 11 illustrates another type of standard outdoor chair 107 which may be detachably mounted to the swivel mechanism of the present invention. The chair 107 has arms 105 and runners 108 and 109 as part of the foldable leg structure of the chair. For this type of chair, the runners 108 and 109 extend substantially parallel to each other and to the direction in which a person sitting in the chair would face. As with the lounge or recliner chair, the runners 108 and 109 may be seated respectively in the channels 90(*a*) and 90 of the channelled supports 88 and 89. The lateral adjustability of the channelled members 88 and 89 permits the conversation of substantially any standard outdoor chair, such as the chair 107, into a swivel chair.

It should be understood that various modifications may be made to the structure disclosed above by way of example without departing from the scope of the present invention. For example, the invention is not limited to use of outdoor chairs having the U-shaped legs with ground-contacting cross-bars as shown herein by way of example. An outdoor chair with four substantially vertical legs may also be converted into a swivel chair. The ends of the legs of the chair may be placed in channels such as the channels 90 and 90(*a*) of the channelled members 88 and 89 or other appropriate means associated with the telescoping supports may be used for gripping the chair legs. In addition, the swivel mechanism itself need not be of the type shown in FIGS. 7–11 consisting of the two opposed plates 74 and 76. The telescoping support position of the present swivel mechanism may be connected through suitable bracing, for example, to the circular tube 36, shown in FIG. 4. In this way, the detachable swivel base and support of the present invention as shown in FIGS. 7–11 may also be adapted to be used with a swivel mechanism of the type shown in FIGS. 1–6 hereof. The present invention is to be limited only by the scope of the following claims.

What is claimed is:

1. A detachable and adjustable swivel base for a chair comprising:

laterally expandable means for releasably engaging each of a chair's legs;

a base member adapted to contact the ground and support a chair in a stable upright manner; and a swivel mechanism pivotally interconnecting said expandable engaging means and said base member, said swivel mechanism having a lower surface and an upper member to which said expandable engaging means is rigidly attached, said upper member being adapted to ride on said lower surface and to rotate relative thereto whereby said chair may be pivoted relative to said base member while being supported in a stable upright manner.

2. The swivel base of claim 1 in which said expandable engaging means comprises means for releasably gripping each of the legs of the chair and a telescoping support member attached to and interconnecting said gripping means whereby said gripping means for each leg may be moved radially inwardly and outwardly relative to the chair thereby to adjust to the distance between the legs of the chair.

3. The swivel base of claim 2 in which each of said gripping means is adapted to engage a pair of the legs of the chair.

4. The swivel base of claim 2 in which said gripping means comprises a plurality of sleeve members each of which is adapted to fit over and releasably to engage at least one of the legs of the chair.

5. The swivel base of claim 4 in which said telescoping support member comprises means for releasably positioning said sleeve members at any one of a plurality of predetermined radial distances from the chair thereby to permit said swivel mechanism to be adjusted to the distance between the legs of the chair.

6. The swivel base of claim 5 in which said telescoping support member comprises at least a pair of tubular rods, the relative diameters of which are such as to permit slidable engagement of one such rod within the other along a common axis.

7. The swivel base of claim 6 in which at least two of said telescoping support members are attached to each of said sleeve members.

8. The swivel base of claim 7 in which said telescoping support members are mounted on said upper member of said swivel mechanism.

9. A revolving chair or recliner comprising a chair or recliner having legs which are releasably engaged by an adjustable swivel base according to claim 1.

10. The revolving chair or recliner of claim 9, wherein said swivel base comprises means for supporting said chair or recliner in a stable upright manner on an outdoor lawn or sand beach surface.

* * * * *